United States Patent [19]

van Weert et al.

[11] Patent Number: 4,678,965

[45] Date of Patent: Jul. 7, 1987

[54] ELECTRON TUBE

[75] Inventors: Michael J. C. van Weert; Gerardus C. S. W. van Limpt, both of Eindhoven, Netherlands

[73] Assignee: U.S. Philips Corporation, New York, N.Y.

[21] Appl. No.: 793,885

[22] Filed: Nov. 1, 1985

[30] Foreign Application Priority Data

Nov. 15, 1984 [NL] Netherlands ..... 8403485

[51] Int. Cl.[4] ..... H01J 29/48

[52] U.S. Cl. ..... 313/451; 313/482

[58] Field of Search ..... 313/451, 456, 457, 477 R, 313/482

[56] References Cited

U.S. PATENT DOCUMENTS 2,171,766 9/1939 Ruska ..... 313/482

2,219,111 10/1940 Nicoll ..... 313/456

2,323,140 6/1943 Lane, Jr. ..... 313/451 X 3,560,780 2/1971 Beeli ..... 313/456

4,520,291 5/1985 Van Rooy et al. ..... 313/482 X

*Primary Examiner*—Palmer C. DeMeo

*Assistant Examiner*—Sandra L. O'Shea

*Attorney, Agent, or Firm*—Robert J. Kraus

[57] ABSTRACT

An electron tube comprises a tubular glass envelope portion (10) having a central axis m and an inside diameter D. In the envelope portion (10) an electrode system (13) is inserted, the central axis l of which coincides with the central axis m. The electrode system (13) comprises a number of resilient elements (16) extending towards the wall of the envelope portion (10) and each pressing against a respective wall portion (19) thereof. The wall portions (19) are a distance $R_1 < D/2$ from the central axis m. In the non-assembled condition of the electrode system, the free ends (18) of the elements (16) are a distance $R_2$ from the central axis l, the relation $R_1 < R_2 < D/2$ being satisfied. This measure permits preventing the occurrence of damage to the wall of the envelope portion (10) when the electrode system (13) is inserted into it.

2 Claims, 2 Drawing Figures

ELECTRON TUBE

BACKGROUND OF THE INVENTION

The invention relates to an electron tube comprising a tubular glass envelope portion having a central axis and an inside diameter D, and an electrode system inserted into the tubular envelope portion and having a central axis which coincides at least substantially with the central axis of the tubular envelope portion. The electrode system comprises a number of resilient elements, which extend towards the wall of the envelope portion and at their free ends each press against a respective inwardly protruding wall portion, of the tubular envelope portion, which has a distance $R_1$ to the central axis, $R_1$ being $<D/2$.

Such an electron tube is known from U.S. Pat. No. 2,171,766. In this Specification a cathode ray tube is described in which the resilient elements, in addition to a centering action, also fix the position of the electrode system in the axial direction. For that purpose the tube neck comprises an internal protuberance which cooperates with an aperture or indentation in the free end of a resilient element, so that a snap connection is formed. When the electrode system is inserted into the tube neck, the metal resilient elements may cause damage to the glass surface in the form of scratches and crumbled-away glass particles. During the further treatment of the tube, such damage may give rise to glass fractures while the crumbled-away particles may land in places in the tube where they can adversely influence the quality of the operation of the tube. Moreover, the resilient elements sliding over the glass wall may leave behind a track of metal particles, as a result of which the required voltage stability is not obtained, particularly in tubes in which high electric operating voltages are applied to certain electrodes. This latter problem is of importance in particular in picture display tubes and projection tubes in which voltages of 16 kV and over are quite normal. Besides display tubes and projection tubes the other problems also play an important part in camera tubes.

SUMMARY OF THE INVENTION

It is an object of the invention to provide an electron tube in which structural measures are taken which minimize the occurrence of glass damage during assembling the electrode system in the tube and ensure a high voltage stability of the system.

The invention is applicable in electron tubes of the type comprising a tubular glass envelope portion having a central axis and an inside diameter D, and containing an electrode system inserted into the tubular envelope portion and having a central axis which coincides at least substantially with the central axis of the tubular envelope portion. The electrode system comprises a number of resilient elements which extend towards the wall of the envelope portion. At their free ends, each resilient element presses against a respective wall portion of the tubular envelope portion which is a distance $R_1$ from the central axis, $R_1$ being $<D/2$. In accordance with the invention, in the non-assembled condition of the electrode system the free ends of the resilient elements are a distance $R_2$ from the central axis of the electrode system, given by $R_1<R_2<D/2$. By means of the measures according to the invention, the contact between the resilient elements and the tube wall is effected only when the electrode system has reached substantially the desired position in the tubular envelope portion. When inserting the electrode system into the tube, the ends of the resilient elements do not contact the tube wall so that the damage mentioned hereinbefore no longer occurs. Each of the inwardly situated wall portions may be formed by local indentations of the tube wall. According to an embodiment of the invention they are formed by a reduction in cross-sectional area of the tubular envelope portion, such that a single indentation is provided which extends continously around the tube.

BRIEF DESCRIPTION OF THE DRAWING

An embodiment of the invention will now be described in greater detail with reference to the accompanying drawing, in which.

DESCRIPTION OF THE PREFERRED EMBODIMENT

Figure 1:
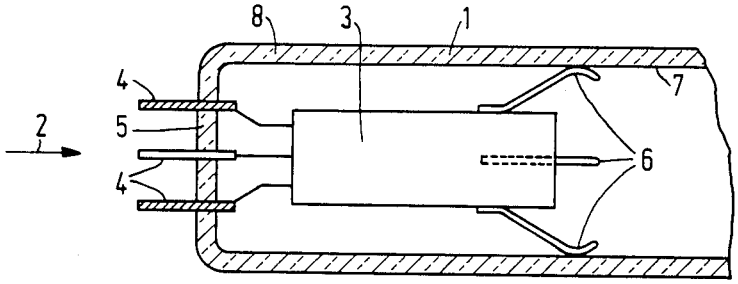
FIG.1 PRIOR ART
FIG. 1 is a diagrammatic longitudinal sectional view of a tubular envelope portion of a known electron tube having an electrode system centered therein.

FIG. 1 shows a tubular glass envelope portion 1 of an electron tube not further shown. This electron tube may be, for example, a picture display tube, in which case the envelope portion 1 represents the neck of the tube. A diagrammatically shown electrode system 3, mounted on a glass mount 5 having electrical connection pins 4 is inserted into the envelope portion 1 in the direction denoted by the arrow 2. The electrode system 3 has a number of metal centering springs 6 which press against the wall 7 of the envelope portion under a pretension. The centering springs center the electrode system 3 with respect to the wall 7, and also serve to damp microphony or other vibrations to which the electrode system may be exposed during operation of the electron tube. After the electrode system 3 has been inserted into the envelope portion 1, the mount 5 is sealed along its circumference to the tubular portion 1 in the place referenced 8 in the Figure. During insertion of the electrode system 3 the springs slide over the wall surface 7, and may cause scratches and crumbling-away of glass particles. Furthermore, tracks of metal particles may remain on the glass wall. It has been found that the crumbled-away glass particles and the tracks of metal particles can reduce the high-voltage stability of the electrode system to the effect that, as a result of their presence, the possibility of the occurrence of electric flash-overs is increased. If the electron tube is a camera tube, such loose particles may land on the photosensitive layer of the tube, as a result of which the tube becomes unfit for further use.

Figure 2:
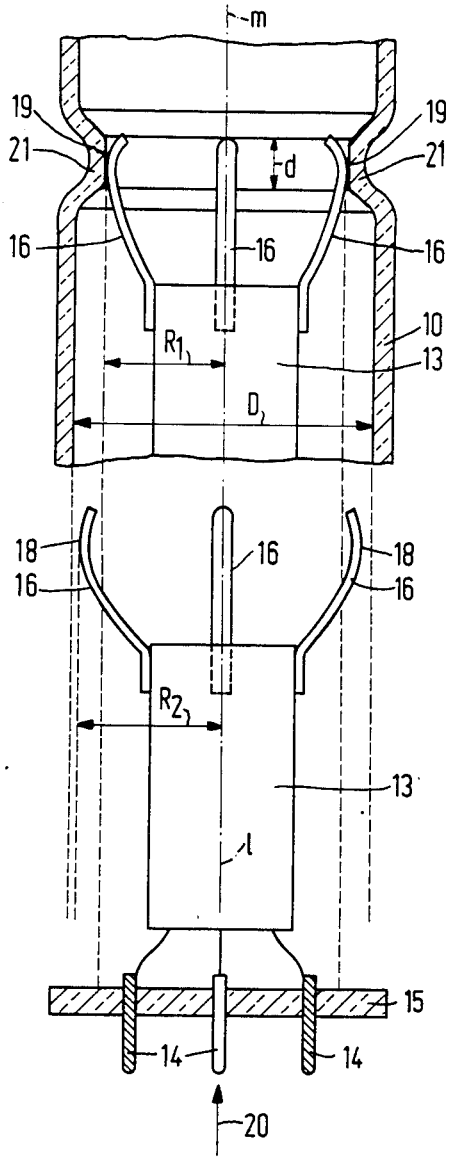
FIG. 2 shows diagrammatically an electrode system prior to and after assembly in a tubular envelope portion of an electron tube according to the invention.

FIG. 2 shows diagrammatically an electrode system prior to and after assembly in a tubular glass envelope portion of an electron tube according to the invention. The not yet assembled, diagrammatically shown, electrode system 13 is mounted on a glass mount 15 provided with electrical connection pins 14. The electrode system 13 has a central axis 1 and comprises a number of chromium-nickel steel resilient elements 16. The free ends of the resilient elements 16 in the non-assembled condition of the electrode system 13 are spaced a distance $R_2$ from the central axis 1. In the embodiment, the elements 16 have a spoon-shaped free end the surface 18 of which, which is eventually to contact a portion of the glass wall, is a distance $R_2$ from the central axis 1. The electrode system is now inserted into a glass envelope portion 10 in the direction denoted by the arrow 20. The partly shown envelope portion 10 has an inside diameter D and a central axis m which coincides or coincides substantially with the axis l of the electrode system 13. The envelope portion 10 shows a reduction in cross-sectional area 21 having an internal wall portion 19 extending over a distance d and being spaced a distance $R_1$ from the central axis m. The place of the reduction in cross-sectional area 21 is located so that in the assembled condition of the electrode system 13 the spoon-shaped ends 18 of the elements 16 press against the wall portion 19. Characteristic of the construction is that between the values D, $R_1$ and $R_2$ the following relation exists: $R_1<R_2<D/2$. When this relation is satisfied, the contact between the elements 16 and the tube wall during inserting the electrode system 13 into the tube 10 is produced only when the electrode system 13 has substantially reached the desired position in the tube 10. In an embodiment, the following values have been chosen for the dimensions D, $R_1$ and $R_2$: $D=32.5$ mm, $R_1=14.5$ mm, and $R_2=16$ mm. The distance d is approximately 7 mm. The reduction in cross-sectional area 21 can simply be obtained by locally heating the glass of the tube 10 to the softening temperature and pressing the tube wall against an internal mandrel of the desired diameter by means of a spatula.

Without departing from the scope of the invention, various embodiments are possible. Instead of the reduction in cross-sectional area 21 described, locally provided reentrant parts may also be used. It is also possible to compose the tubular envelope portion 10 from two tubes the inside diameters of which are $D_1$ and $D_2$, respectively, where $D_1=D$ and $D_2=2\ R_1$.

The invention may furthermore be used advantageously in electron tubes the inner wall of which comprises an electrically conductive layer. By using the invention, damage of this electrically conductive layer is avoided during assembly of the electrode system in the tube.

What is claimed is:

1. An electron tube including a tubular glass envelope portion having a central axis and an inside diameter D, an electrode system in the envelope portion having a central axis, means for axially positioning the electrode system in the envelope portion, and centering means for positioning the electrode system in the envelope portion such that the electrode system axis substantially coincides with the envelope portion axis;

characterized in that said centering means comprises:

(a) a plurality of predefined contact surfaces in the envelope portion, each disposed at a predetermined axial position and spaced from the envelope portion axis by a distance $R_1$ which is smaller than D/2; and (b) a plurality of resilient elements extending from the electrode system and having free ends radially spaced from the electrode system axis by a distance $R_2$ when the resilient elements are in a relaxed state, where $R_1<R_2<D/2$, said resilient elements being positioned and dimensioned such that their free ends are depressed radially inward by respective ones of the contact surfaces when the electrode system is fully installed in the envelope portion;

said centering means enabling installation of the electrode system without any contact between the centering means and the envelope portion except at the predefined contact surfaces.

2. An electron tube as in claim 1 where the contact surfaces are formed by a single indentation in the envelope portion which extends around the circumference of said envelope portion.

* * * * *